United States Patent [19]

Schuller

[11] 4,004,156

[45] Jan. 18, 1977

[54] SINGLE BUS DC CONTROL CIRCUIT

[76] Inventor: Ronald M. Schuller, 552 Treadway Blvd., Sheffield Lake, Ohio 44054

[22] Filed: Nov. 26, 1975

[21] Appl. No.: 635,332

[52] U.S. Cl. ..... 307/113; 318/293; 212/21

[51] Int. Cl.[2] ..... H01H 19/64

[58] Field of Search ..... 307/112, 113, 114, 115, 307/43, 138; 318/256, 257, 305, 293; 212/20, 21

[56] References Cited

UNITED STATES PATENTS

| | | | |
|---|---|---|---|
| 1,102,550 | 7/1914 | Schiebeler | 212/132 |
| 2,332,390 | 10/1943 | Manney | 318/257 |
| 3,078,406 | 2/1963 | Zweifel et al. | 318/305 |
| 3,179,869 | 4/1965 | Cory | 318/257 |

*Primary Examiner*—Robert K. Schaefer
*Assistant Examiner*—Morris Ginsburg
*Attorney, Agent, or Firm*—Fay & Sharpe

[57] ABSTRACT

A DC control circuit supplies direct current of either polarity at a high or a low level to a crane hoist or the like via a single bus bar to control up, down, low or high speed functions. A network of diodes and ganged switches at a remote control panel supplies the selected level and direction of current to the bus bar while a control circuit moving with the powered equipment responds to the voltage level and polarity picked off of the bus bar by means of a high voltage responsive relay coil circuit and dual, parallel, diode, relay coil circuits responsive to polarity.

15 Claims, 2 Drawing Figures

SINGLE BUS DC CONTROL CIRCUIT

BACKGROUND OF THE INVENTION

The invention relates generally to direct current (DC) control circuits for traveling cranes and the like.

While the invention described below is directed to a particular problem relating to remote controlled bridge (over-head-traveling) cranes, the principle of the invention is applicable in a directly analogous fashion to other types of moving equipment which is powered through contacts sliding on a bus bar or equivalent means of electrification.

Bridge cranes are useful in moving articles within a large rectangular area such as warehouse floor or assembly area in a factory. This type of crane has a moving bridge which spans a pair of stationary overhead parallel rails called the runway. The bridge has wheels (bridge trolley) which ride on the parallel rails, and the means for driving the wheels is normally carried on the bridge itself. The hoist mechanism is mounted on a hoist trolley which rides along the length of the bridge. The direction of the hoist trolley movement is perpendicular to the direction of the bridge movement. The third degree of motion is provided by raising and lowering the hoist hook by operating the hoist motor or winch. Each of the DC motors carried on the bridge to drive the bridge trolley, hoist trolley and hoist must be capable of imparting forward and reverse (up and down) motion at two speeds.

The various means of controlling the motors on the bridge in the past required a plurality of bus bars (power line) along the length of the runway for each motor. The bus bars for two motors must also be supplied along the length of the bridge itself to accommodate the movement of the hoist trolley.

In the past, three different concepts have been used for bridge crane control: (1) pendant; (2) operator cab or cage; and (3) remote station. For pendant control a manual push-button controller is suspended from the hoist trolley. For more frequent crane operation, operator cab control is used; the cab is mounted directly to the bridge so that an operator can control all of the functions from the bridge. The remote control system uses a stationary control panel from which all of the bridge crane motions are commanded from a single location on the floor.

Typically, a bridge crane with reversible two-speed hoist, hoist trolley and bridge trolley motors can be remotely controlled by wall-mounted push buttons with ten conductors of runway control electrification and seven conductors of bridge control electrification. For each motor one bus bar is required for forward motion, one for reverse motion and one for each second or higher speed of operation, plus one bus bar for common or ground to serve all motors. Total electrification for the runway thus requires the following bus bar designation: common ground, bridge forward, bridge reverse, bridge high (a higher speed), hoist trolley forward, hoist trolley reverse, hoist trolley high, hoist up, hoist down, and hoist high — a total of ten different bus bars running the entire length of the runway. The electrification on the bridge can be designated: common ground, hoist trolley forward, hoist trolley reverse, hoist trolley high, hoist up, hoist down and hoist high — a total of seven separate bus bars.

Considering a typical bridge span of 40 feet and runway of 100 feet, a total of 1,280 linear feet of control electrification is necessary. Including hangers, collectors (shoes) and labor, the present installation cost is on the order of $6 per linear foot. Thus a reduction in the number of runway control bus bars needed for electrification of the bridge systems would be highly desirable.

SUMMARY OF THE INVENTION

The general purpose of the invention is to reduce the number of bus bars required in bridge crane structures and the like. This objective is achieved by a circuit in which a stationary remote control panel controls two directions and two or more speeds using a single bus bar (plus common ground) for each crane motor. Accordingly, the runway would require only three bus bars corresponding to the three motors on the bridge plus a fourth bar for the common or ground contact instead of the ten previously required. Likewise, the bridge would require only three bus bars instead of seven. The previously mentioned crane example would require only 520 linear feet of electrification using the system of the present invention in contrast to the 1,280 linear feet formerly required for the same functions.

The circuit employs a network of ganged switches and diodes at a stationary control panel to supply current of the proper level and direction to a single bus bar (corresponding to one of the motors). A collector rides with the bridge or equivalent structure and supplies current from the bus bar to a moving control circuit which is preferably implemented by a relay circuit having three parallel branches connected between the collector and common ground. Two of the branches are adapted to differentiate direction of current flow by means of diodes mounted in series with respective relay coils. Another branch is indifferent to polarity but includes a relay coil connected in series with a resistor such that the coil is operatively energized only by a high level of current. Sufficient energization of the high relay coils switches resistors into the other two branches so that the "up" and "down" (forward and reverse) relay coils are energized to the same extent by the high current level as they are by the low current level.

DESCRIPTION OF THE PREFERRED EMBODIMENT

Figure 1:
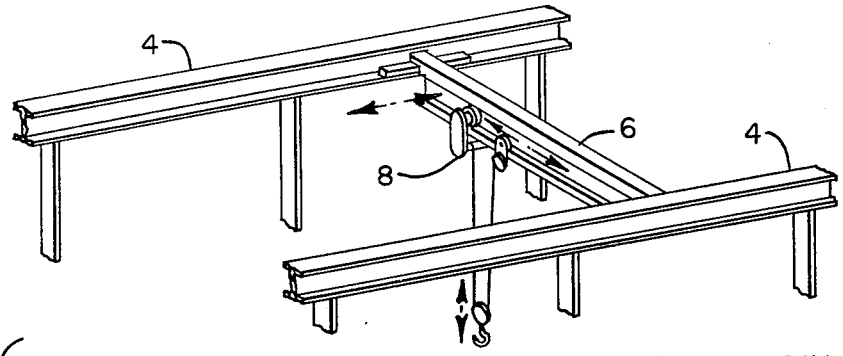
FIG. 1 is a schematic drawing illustrating a typical bridge crane.

A typical bridge crane, as shown in FIG. 1, includes a runway 4 formed by a pair of overhead parallel rails, a transverse bridge 6 spanning the rails of the runway 4 and movable along the runway by a conventional bridge trolley mechanism, and a hoist trolley 8 either suspended from or supported on a linear track running the length of the bridge 6. The hoist trolley 8 carries a trolley motor for moving the hoist along the bridge 6 and hoisting apparatus including suitable tackle powered by a reversible hoist motor for raising and lowering the hoisting hook.

Figure 2:
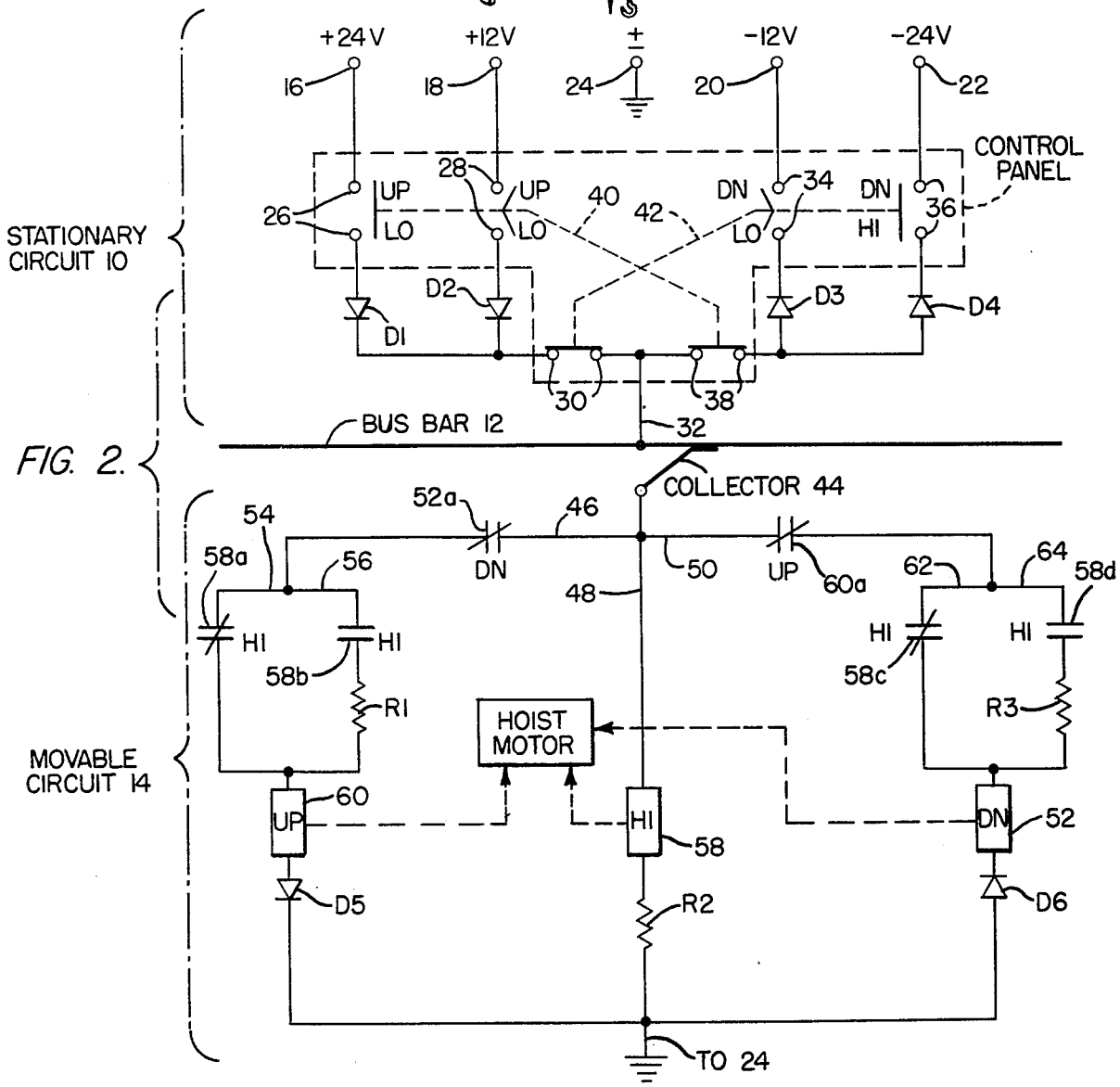
FIG. 2 is an electrical schematic circuit drawing illustrating a preferred embodiment of a single bus DC control circuit according to the invention providing electrification for a single hoist motor on the bridge crane of FIG. 1.

In the circuit of FIG. 2, power is supplied to operate a hoist motor or the like by means of a stationary control circuit 10 via a stationary bus bar or trolley wire 12 to a movable control circuit 14 which would be mounted on the hoist trolley 8. Thus the bus bar 12 symbolically represents both runway and bridge electrification. The bus bar on the bridge 6 would be connected via another collector to the corresponding bus bar along the runway 4.

In the embodiment described herein, the control circuit 10 is stationary in the true sense, for example, as a panel mounted on a wall of a building. However, in crane installations where an operator cab on the bridge 6 is necessary, the control circuit 10 would be located in the cab, and "stationary" in that situation would mean stationary relative to the bridge. Bus bar control would still be used in that case for the hoist motor and the control circuitry would be substantially as described herein.

The stationary circuit 10 employs a DC power supply with the output arranged like four 12 volt batteries connected in series with the center connection grounded. The power supply thus provides positive terminals 16 and 18 at 24 and 12 volts respectively, negative terminals 20 and 22 at 12 volts and 24 volts respectively and a common ground terminals 24. The positive terminals, 16 and 18 are used in connection with two-speed operation of the hoist motor while raising the hook. Likewise, the negative terminals 20 and 22 are used for lowering the hook at two different speeds. Raising and lowering the hoisting hook is directly analogous to running the hoist trolley 8 back and forth on the bridge 6 or the bridge 6 back and forth along the runway 4. Thus the description of this embodiment as a control circuit for the hoist motor is merely illustrative of the type of control functions accomplished by this circuit. The positive high voltage terminal 16 is connected via push-button switch contacts 26 to a series diode D1 connected to be forward-biased by positive voltage from the terminal 16. The positive low voltage terminal 18 is similarly connected via a pair of push-button contacts 28 to a similarly oriented series diode D2. Diodes D1 and D2 are connected in common via push-button safety switch contacts 30 to a feeder line 32 connected directly to the bus bar 12. On the negative side, the low and high negative voltage terminals 20 and 22 are connected respectively via push-button switch contacts 34 and 36 to respective diodes D3 and D4 connected in the opposite fashion from the diodes D1 and D2 so as to be forward-biased by reverse current flowing to the negative voltage terminals 20 and 22. The diodes D3 and D4 are connected in common via push-button safety switch contacts 38 to the line 32 and bus bar 12.

The six pairs of push-button switch contacts described above are operated by a pair of ganged push-button switches 40 and 42. The ganged switch 40 is a conventional break-before-make push-button switch having two discrete operative levels of depression. Depression of switch 40 to the first level causes normally closed safety switch contacts 38 on the negative side to be opened and contacts 28 for low positive voltage to be closed for raising the hoist at low speed (UP LOW) without closing the contacts 26 for the high speed raising operation at high voltage. Further depression of the push-button switch 40 to the second level first breaks the connection between contacts 28 (UP LOW) and then closes contacts 26 (UP HIGH). The normally closed contacts 38 remain open at both levels of depression of the push-button switch 40. The ganged push-button switch 42 operates in the same manner for two-speed lowering. The normally closed safety contacts 30 and 38 insure against the effects of accidental actuation of both switches 40 and 42 at the same time. The diodes D1 and D4 insure complete isolation of the positive and negative high and low voltage terminals.

The movable control circuit 14 is powered via a collector, shoe or pantograph 44 which slides along the bus bar as the hoist trolley moves along the bridge or as the bridge moves along the runway. The collector 44 is connected directly to three parallel branch circuits 46, 48 and 50. The left-hand branch 46 includes a pair of normally closed contacts **52*a* operated by the DOWN relay 52 in series with the right-hand branch 50. The contacts 52*a* are connected in series with alternate parallel paths 54 and 56 in the left-hand branch 46. In the path 54, normally closed contacts 58*a* are operated by a HIGH relay coil 58 connected to common ground via a resistor R2 in the middle branch 48. The alternate path 56 includes a resistor R1 in series with a normally open contact 58*b* operated by the HIGH coil 58. The alternate paths 54 and 56 are connected in series with an UP relay coil 60, which in turn is connected in series to common ground via a diode D5 connected such that current can only flow in the left-hand branch 46 when one of the positive terminals 16 and 18 is interconnected with bus bar 12.**

The right-hand branch 50 includes normally closed relay coil contacts **60*a* operated by the UP coil 60 in the left-hand branch circuit. The relay coil contacts 60*a* are connected in series to alternate paths 62 and 64 implemented in exactly the same fashion as in the left branch 46. The path 62 thus includes normally closed HIGH relay contacts 58*c* and the path 64 includes normally open HIGH relay contacts 58*d* connected in series with a resistor R3. The alternate paths 62 and 64 are connected in common to the DOWN relay coil 52 which in turn in connected to common ground via a diode D6 connected to be forward-baised by the negative terminal 20 or 22 in the stationary control circuit 10.**

In operation, by pressing the UP push button 40 in until the UP LOW contacts 28 close, plus 12 volts current flows to the UP relay coil 60 via diode D2, normally closed contacts 30, bus bar 12, collector 44, normally closed DOWN contacts **52*a* and normally closed HIGH contacts 58*a*, through the UP relay coil 60 and diode D5 to common ground for a complete circuit. Further depression of the UP button 40 breaks the positive 12 volt UP LOW circuit and closes the UP HIGH 24 volt circuit. The high positive current flows through diode D1, normally closed contacts 30, bus bar 12, collector 44, HIGH relay coil 58, resistor R2, to common ground. The current at this level flowing through the HIGH coil 58 is sufficient to energize the coil to switch the HIGH relay coil contacts 58*a* through 58*d*. The 24 volt positive current also flows from the collector 44 to the normally closed DOWN contacts 52*a*, normally open HIGH contacts 58*b* (now closed), resistor R1, UP coil 60 and diode D5 to common ground, maintaining the upward direction of travel at the higher speed. The resistors R1 and R2 bias the 12 volt relays for 24 volt operation. Thus all of the relay coils 52, 58 and 60** are interchangeable. The operation of the circuit for downward travel with one of the negative voltage terminals connected is analogous to operation in the upward direction.

The invention may be embodied in other specific forms without departing from its spirit or essential characteristics. For example, the same circuit can be implemented with equivalent solid state logic circuitry. Moreover additional speeds (voltage levels) beyond the two described herein can be implemented in an iterative fashion. The present embodiment is, therefore, to be considered in all respects as illustrative and not restrictive, the scope of the invention being indicated by the claims rather than by the foregoing description; and all changes which come within the meaning and range of the equivalents of the claims are therefore intended to be embraced therein.

What is claimed is:

1. A DC control circuit comprising:

a bus bar;

a primary circuit including a DC voltage source of high and low positive and of high and low negative voltage, selector means operatively connected between said bus bar and said voltage source for selectively applying said high or low positive or negative voltage to said bus bar; f a secondary circuit including collector means for making electrical contact with said bus bar and a voltage polarity and voltage level responsive circuit operatively connected to said collector means including polarity means for producing an output condition indicative of the polarity of voltage applied to said bus bar and voltage level means for producing an output condition indicative of a said high or low voltage applied to said bus bar and;

means responsive to the operation of said secondary circuit for operating a device in a mode corresponding to said polarity means output condition and at a rate corresponding to said voltage level means output condition.

2. The circuit of claim 1, wherein said polarity means includes first and second branch circuits connected in parallel with said collector means, said voltage level means including a third branch circuit connected in parallel with said first and second branch circuits, first, second and third relay coils being connected in series in the respective branch circuits, said third relay coil being operable only by a high voltage level on said bus bar, said first and second branch circuits including respectively in series with said first and second relay coils normally closed relay contacts operated respectively by said second and first relay coils, said first branch circuit including in series with said first relay coil a first diode connected to be forward-biased by the application of positive voltage to said bus bar, said second branch circuit including in series with said second relay coil a second diode connected to be forward-biased by the application of negative voltage to said bus bar, said first and second branch circuits each including identical parallel subcircuits having one path with a pair of normally closed relay contacts operated by said third relay coil and an alternate path with a resistor in series with a pair of normally open relay contacts operated by said third relay coil, said resistor being sized to compensate for the difference between high and low voltage levels to achieve equivalent energization of the first or second relay coil respectively, at either voltage level.

3. The circuit of claim 2, wherein said third branch circuit includes a resistor in series with said third relay coil sized to enable operative energization of said third relay coil only by said high voltage level.

4. The circuit of claim 3, wherein said first, second and third relay coils are interchangeably identical.

5. The circuit of claim 2, wherein said voltage source includes a pair of high and low positive voltage terminals and a pair of high and low negative voltage terminals, said selector means including four pairs of normally open switch contacts respectively connecting said terminals in parallel to said bus bar and third, fourth, fifth and sixth diodes respectively connected to be forwarded-biased by said respective terminals between said bus bar and each pair of said switch contacts.

6. The circuit of claim 5, wherein said primary circuit further includes first and second push-button break-before-make switch means corresponding respectively to voltage polarity each having two discrete levels of depression including means for making a low voltage circuit with a first pair of said normally open contacts at a first level of depression and, with further depression to the second level, breaking the low voltage circuit and then making a high voltage circuit of the same polarity with a second pair of normally open switch contacts.

7. The circuit of claim 6, wherein each pair of said third, fourth, fifth and sixth diodes interconnected with terminals of the same polarity is connected in common via a pair of normally closed safety switch contacts to said bus bar, said push-button switch means having means for keeping the normally closed safety contacts for the opposite polarity open at either level of depression.

8. A single bus traveling crane DC control circuit comprising:

bus bar means for providing electrification for a moving crane element;

a primary manually operable control circuit including a multilevel dual polarity DC voltage source with a pair of high and low positive voltage terminals and a pair of high and low negative voltage terminals, selector circuit means interconnected with said voltage source for applying DC voltage of a selected level and polarity to said bus bar means;

a secondary circuit movable relative to said primary circuit and adapted to be operatively interconnected with said crane element, including collector means for making moving electrical contact with said bus bar means and a voltage polarity and voltage level responsive circuit operatively connected to said collector means including polarity means for producing an output condition indicative of the polarity of voltage applied to said bus bar means and voltage level means for producing an output condition indicative of a high or low voltage applied to said bus bar means; and means responsive to the operation of said secondary circuit for operating said crane element in a mode corresponding to said polarity means output condition and at a rate corresponding to said voltage level means output condition.

9. The circuit of claim 8, wherein said polarity means includes first and second branch circuits connected in parallel with said collector means, said voltage level means including a third branch circuit connected in parallel with said first and second branch circuits, first, second and third relay coils being connected in series in the respective branch circuits, said third relay coil being operable only by a high voltage level on said bus bar means, said first and second branch circuits including respectively in series with said first and second relay coils normally closed relay contacts operated respectively by said second and first relay coils, said first branch circuit including in series with said first relay coil a first diode connected to be forward-biased by the application of positive voltage to said bus bar means, said second branch circuit including in series with said second relay coil a second diode connected to be forward-biased by the application of negative voltage to said bus bar means, said first and second branch circuits each including identical parallel subcircuits having one path with a pair of normally closed relay contacts operated by said third relay coil and an alternate path with a resistor in series with a pair of normally open relay contacts operated by said third relay coil, said resistor being sized to compensate for the difference between high and low voltage levels to achieve equivalent energization of the first or second relay coil, respectively, at either voltage level.

10. The circuit of claim 9, wherein said third branch circuit includes a resistor in series with said third relay coil sized to enable operative energization of said third relay coil only by said high voltage level.

11. The circuit of claim 10, wherein said first, second and third relay coils are interchangeably identical.

12. The circuit of claim 9, wherein said voltage source includes a pair of high and low positive voltage terminals and a pair of high and low negative voltage terminals, said selector means including four pairs of normally open switch contacts respectively connecting said terminals in parallel to said bus bar means, and third, fourth, fifth and sixth diodes respectively connected to be forward-biased by said respective terminals between said bus bar means and each pair of said switch contacts.

13. The circuit of claim 12, wherein said primary circuit further includes first and second push-button break-before-make switch means corresponding respectively to voltage polarity each having two discrete levels of depression for making a low voltage circuit with a first pair of said normally open contacts at a first level of depression and, with further depression to the second level, breaking the low voltage circuit and then making a high voltage circuit for the same polarity with a second pair of said normally open switch contacts.

14. The circuit of claim 13, wherein each pair of said third, fourth, fifth and sixth diodes interconnected with terminals of the same polarity is connected in common via a pair of normally closed safety switch contacts to said bus bar means, said push-button switch means having means for keeping the normally closed safety contacts for the opposite polarity open at either level of depression.

15. A DC control circuit comprising:

a DC voltage source of high and low positive and of high and low negative voltage;

a power line;

means for selectively applying said DC high and low positive or said DC high and low negative voltage to said line;

a circuit electrically connected to said line including polarity means for producing an output condition indicative of the polarity of voltage applied to said line and voltage level means for producing an output condition indicative of a high or low voltage applied to said line; and means responsive to the operation of said circuit for operating a device in a mode corresponding to said polarity means output condition and at a rate corresponding to said voltage level means output condition.

* * * * *